US009644312B2

(12) United States Patent
Kang et al.

(10) Patent No.: US 9,644,312 B2
(45) Date of Patent: May 9, 2017

(54) METHOD FOR PRODUCING SYNTHETIC LEATHER HAVING AIR PERMEABILITY

(75) Inventors: Gun Kang, Seoul (KR); Mi Jung Yun, Gyeonggi-do (KR); Jeong Seok Oh, Gyeonggi-do (KR); Seong Hoon Lee, Ulsan (KR); Kie Youn Jeong, Gyeonggi-do (KR); Chang Suk Koh, Gyeonggi-do (KR)

(73) Assignees: Hyundai Motor Company, Seoul (KR); Kia Motors Corporation, Seoul (KR); Il Jeong Industrial Co., Ltd., Ansan, Gyeonggi-do (KR)

( * ) Notice: Subject to any disclaimer, the term of this patent is extended or adjusted under 35 U.S.C. 154(b) by 366 days.

(21) Appl. No.: 13/279,812

(22) Filed: Oct. 24, 2011

(65) Prior Publication Data

US 2012/0308726 A1 Dec. 6, 2012

(30) Foreign Application Priority Data

Jun. 1, 2011 (KR) ..... 10-2011-0052630

(51) Int. Cl.
*D06N 3/00* (2006.01)
*D06N 3/14* (2006.01)

(52) U.S. Cl.
CPC ..... *D06N 3/004* (2013.01); *D06N 3/14* (2013.01); *D06N 2211/28* (2013.01)

(58) Field of Classification Search
CPC ..... D06N 3/004; D06N 3/14; D06N 3/145; D06N 2211/28
USPC ..... 427/270, 210
See application file for complete search history.

(56) References Cited

U.S. PATENT DOCUMENTS

| | | | | |
|---|---|---|---|---|
| 1,406,710 | A * | 2/1922 | Wilson | 428/86 |
| 3,090,097 | A * | 5/1963 | Ruckstuhl | 28/162 |
| 3,325,322 | A * | 6/1967 | Satas | 156/62.2 |
| 5,626,950 | A * | 5/1997 | Shimano et al. | 442/76 |
| 2003/0092832 | A1* | 5/2003 | Tanaka et al. | 524/589 |

(Continued)

FOREIGN PATENT DOCUMENTS

| | | |
|---|---|---|
| CN | 1676744 A | 10/2005 |
| CN | 1957137 A | 5/2007 |

(Continued)

OTHER PUBLICATIONS

Machine Translation of JP 2007138310 A.*

*Primary Examiner* — Alex A Rolland
(74) *Attorney, Agent, or Firm* — Mintz Levin Cohn Ferris Glovsky and Popeo, P.C.; Peter F. Corless

(57) ABSTRACT

Disclosed is a synthetic leather produced by directly coating a water-soluble synthetic resin solution on the surface of a fabric to form a film thereon such that fine gaps formed on the fabric are partially left open to have a certain degree of air permeability. In particular, a brushing process is used for brushing the surface of a fabric using a brushing machine to raise a nap. Next, a hydrolysis-resistant and flame-retardant resin solution is coated on the back of the fabric, which is opposite to the surface on which the nap is raised, to reinforce the back of the fabric. A film forming process then applies a water-soluble polyurethane resin solution to the nap raised on the surface of the fabric to form a film on the surface of the fabric thereby producing a synthetic leather product that has air permeability properties that are superior to genuine leather.

5 Claims, 7 Drawing Sheets

(56) References Cited

U.S. PATENT DOCUMENTS

| | | | | |
|---|---|---|---|---|
| 2006/0141228 | A1* | 6/2006 | Rearick et al. | 428/212 |
| 2008/0045104 | A1* | 2/2008 | Sugiyama et al. | 442/141 |

FOREIGN PATENT DOCUMENTS

| | | | | |
|---|---|---|---|---|
| CN | 101027445 | A | | 8/2007 |
| CN | 101106917 | A | | 1/2008 |
| CN | 101218392 | A | | 7/2008 |
| CN | 101506432 | A | | 8/2009 |
| CN | 101886341 | A | | 11/2010 |
| CN | 102061629 | A | | 5/2011 |
| JP | 07018584 | A | | 1/1995 |
| JP | 2005002512 | A | | 1/2005 |
| JP | 2007138310 | A | * | 6/2007 |
| JP | 2008081916 | A | | 4/2008 |
| JP | 2009235628 | A | | 10/2009 |
| KR | 10-2001-0073891 | A | | 8/2001 |
| KR | 10-2004-0067503 | A | | 7/2004 |
| KR | 10-2009-0045202 | | | 5/2009 |
| KR | 10-2012-0017588 | A | | 2/2012 |

* cited by examiner

METHOD FOR PRODUCING SYNTHETIC LEATHER HAVING AIR PERMEABILITY

CROSS-REFERENCE TO RELATED APPLICATION

This application claims under 35 U.S.C. §119(a) the benefit of Korean Patent Application No. 10-2011-0052630 filed Jun. 1, 2011, the entire contents of which are incorporated herein by reference.

BACKGROUND (a) Technical Field

The present disclosure relates to a method for producing synthetic leather. More particularly, it relates to a method for producing synthetic leather, which is suitable for vehicle interior materials (such as seat covers, door trim sheets, etc.) and has improved air permeability, which is similar to that of genuine leather. Moreover, the synthetic leather produced by the present invention has increased hydrolysis resistance and chemical resistance, which genuine leather does not have, increased flame retardancy and, at the same time, has improved adhesion between a fabric and a film along with improved film texture.

(b) Background Art

Generally, synthetic leather is a fabric produced by forming a film with a synthetic resin such as polyvinyl alcohol (PVA) or polyurethane (PU) on a release paper (RP), on which a leather pattern or other predetermined pattern is embossed, and bonding the resulting film to a woven fabric, knitted fabric, or nonwoven fabric using an adhesive. The methods for producing synthetic leather generally include a dry method and a wet method.

According to the dry method, a film is formed on the surface of a release paper using a polyurethane solution or solvent-based polyurethane (PU) resin (prepared by dissolving polyurethane in toluene and methyl ethyl ketone (MEK). That is, a solvent-based polyurethane solution, for example, is coated on a release paper and dried to form a film on the release paper. Then, the resulting release paper is bonded to a fabric coated with an adhesive and dried, and the release paper is removed from the film, thereby forming the final film on the fabric.

The wet method, utilizes a resin, such as solvent-based PU resin, capable of forming a film is padded onto the surface of a fabric or onto the entire fabric. Alternatively, a PU resin may be coated on the surface of a fabric (such as a woven fabric, knitted fabric, or nonwoven fabric) embedded in a synthetic resin by gravure coating, for example, thus forming a film. Moreover, a wet/dry method, in which a release paper is attached to the thus formed film, may be used.

However, the synthetic leather produced by the above-described conventional methods, in which the thus formed film is bonded to the surface of the fabric by an adhesive, has no air permeability similar to that of genuine leather, since the surface of the fabric is completely covered by the film, as shown in the images of FIGS. 6A, 6B, 7A and 7B.

Moreover, the use of adhesives causes contaminants such as volatile organic compounds (VOCs) and odors, not to mention that the use of solvents (such as toluene and MEK), which may be harmful to the human body, is not environmentally friendly.

The above information disclosed in this Background section is only for enhancement of understanding of the background of the invention and therefore it may contain information that does not form the prior art that is already known in this country to a person of ordinary skill in the art.

SUMMARY OF THE DISCLOSURE

The present invention has been made in an effort to solve the above-described problems associated with prior art. Accordingly, the present invention provides a method for producing synthetic leather, which is suitable for vehicle interior materials and has air permeability which is similar to that of genuine leather. The synthetic leather is produced by directly coating a water-soluble synthetic resin solution on the surface of a fabric to form a film thereon such that no volatile organic compounds (VOCs) and odors are generated and fine gaps formed on the fabric are partially left to have a certain degree of air permeability. Moreover, the synthetic leather produced by the present invention has increased hydrolysis resistance and chemical resistance, which genuine leather does not have, and improved durability and texture.

In one aspect, the present invention provides a method for producing synthetic leather having air permeability, the method comprising: a brushing process for brushing the surface of a fabric using a brushing machine to raise a nap; a back reinforcing process for coating a hydrolysis-resistant and flame-retardant resin solution on the back of the fabric, which is opposite to the surface on which the nap is raised, to reinforce the back of the fabric; and a film forming process for applying a water-soluble polyurethane resin solution to the nap raised on the surface of the fabric to form a film on the surface of the fabric.

In an exemplary embodiment, the method of the present invention further comprises: a pattern forming process for forming a pattern by performing an embossing process on the film disposed on the surface of the fabric after the film forming process has been completed; a painting process for imparting a color by spraying a water-soluble resin solution, which contains a pigment and a carbodiimide curing agent for improving water resistance and chemical resistance, on the surface of the film after the pattern forming process; and a surface reinforcing process for increasing the surface durability by spraying a top protective resin solution on the surface of the film after the painting process.

In another exemplary embodiment, the method of the present invention further comprises, performing before the brushing process, a softening process for imparting flexibility to the surface of the fabric by immersing the fabric in a softening solution containing a softener diluted in water and stored in a reservoir and drying the resulting fabric.

In still another exemplary embodiment, in the back reinforcing process, a hydrolysis-resistant and flame-retardant resin solution in an amount of about 52 to 60 g/m$^2$ is coated on the back of the fabric to reinforce the back texture of the fabric.

In yet another exemplary embodiment, in the film forming process, a water-soluble polyurethane resin solution in an amount of about 50 to 60 g/m$^2$ is applied to the nap of the fabric to form a film.

In still yet another exemplary embodiment, the film forming process comprises: a first coating process for coating a predetermined amount of hydrolysis-resistant, flame-retardant, and water soluble polyurethane resin solution on the surface of the fabric; a planarization process for planarizing and drying the surface of the film by heating and pressurizing the film after the first coating process; and a second coating process for coating the remaining amount of hydrolysis-resistant, flame-retardant, and water soluble polyurethane resin solution on the surface of the film after the planarization process.

In a further exemplary embodiment, in the first coating process, the water-soluble polyurethane resin solution in an amount of about 80 to 84% of the total weight is coated on the surface of the film and, in the second coating process, the water-soluble polyurethane resin solution in an amount of about 16 to 20% of the total weight is coated on the surface of the film.

In another further exemplary embodiment, in the planarization process, the film after the first coating process is dried by heating at a temperature of about 130 to 160° C.

In still another further exemplary embodiment, in the planarization process, the fabric after the first coating process is passed through a hot press roller such that the fabric is heated and pressurized at the same time.

Other aspects and exemplary embodiments of the invention are discussed infra.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
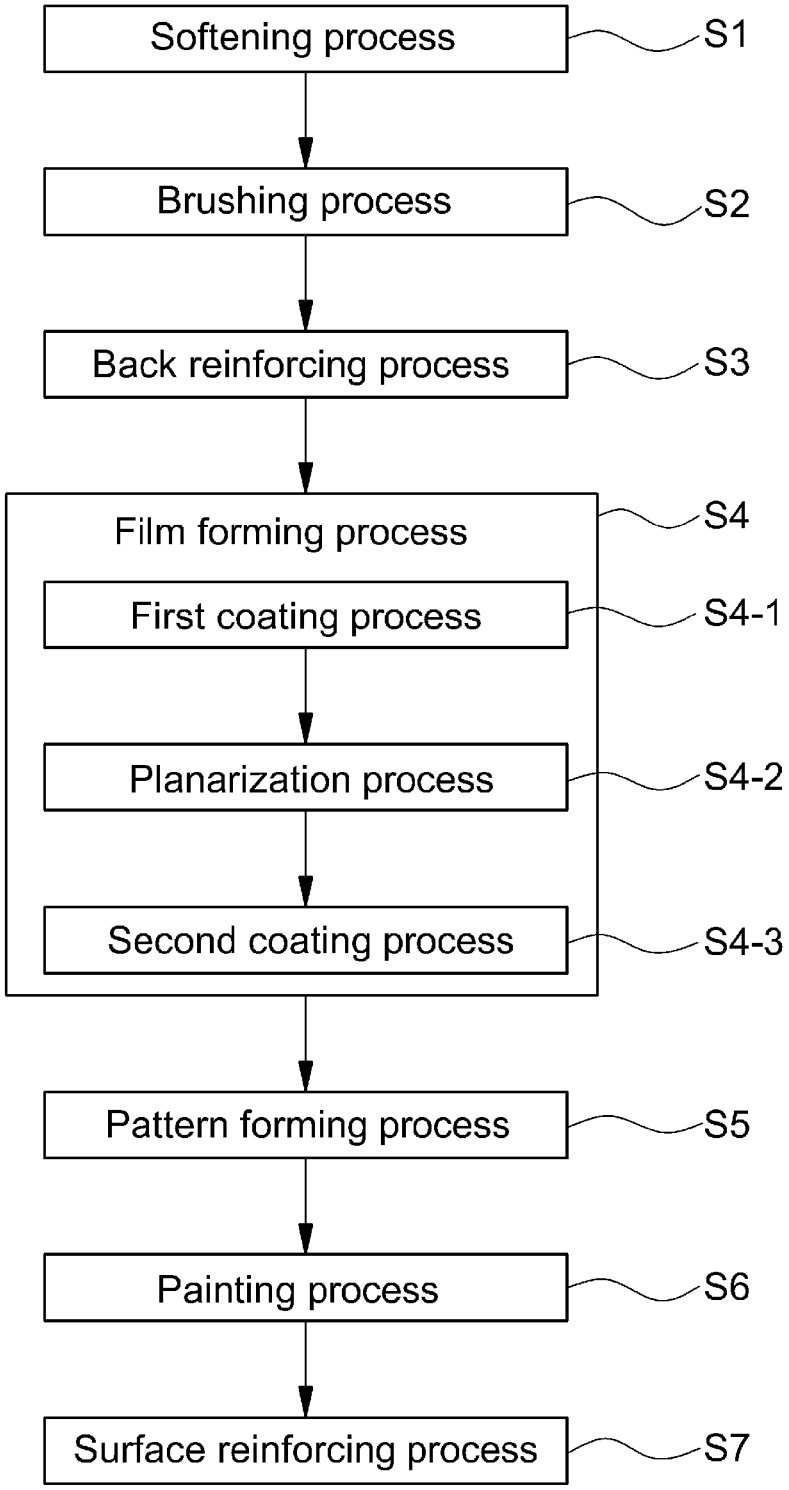
FIG. 1 is a flowchart showing a method for producing synthetic leather according to an exemplary embodiment of the present invention.

Reference numerals set forth in the Drawings includes reference to the following elements as further discussed below:

11: softening solution
12: reservoir
20: brushing fillets
21: fillets
22: drum
31: coating agent
32: coating machine
41: coating machine
42: hot press roller
43: coating machine It should be understood that the appended drawings are not necessarily to scale, presenting a somewhat simplified representation of various exemplary features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Unless specifically stated or obvious from context, as used herein, the term "about" is understood as within a range of normal tolerance in the art, for example within 2 standard deviations of the mean. About can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

The present invention provides a method for producing synthetic leather applicable to vehicle interior materials such as seat covers, door trim sheets, etc.

In particular, the synthetic leather produced by the present invention has air permeability, which is similar to that of genuine leather, increased hydrolysis resistance and chemical resistance, which genuine leather does not have, improved flame retardancy, and adhesion between a fabric and a film which has a more desirable film texture.

As shown in FIG. 1, the method for producing synthetic leather having air permeability comprises a softening process (S1), a brushing process (S2, or nap-raising process), a back reinforcing process (S3), and a film forming process (S4). Examples of fabrics used in the production of synthetic leather include knitted fabrics (such as Tricot brushed fabrics), woven fabrics, and nonwoven fabrics, which have good air permeability due to the large number of spaces between the threads and are easy to raise the nap on the surface.

First, where a film is to be formed, the softening process (S1) is performed on the surface of a fabric before raising a nap to impart flexibility to the surface of the fabric, thus facilitating the brushing process (S2). As shown in (a) of FIG. 2, a softening solution 11 containing a softener such as a wax or silicone-based softener diluted in water may be stored in a reservoir 12, and a fabric W may be immersed in the softening solution 11 to absorb the softener and is then dried.

Subsequently, the brushing process is performed after the softening process (S1) by brushing the surface of the fabric using a brushing machine such as brushing fillets, thus raising a loop-type nap. As shown in (b) of FIG. 2, brushing fillets 20 composed of fillets 21 bent in a predetermined direction on a drum 22 are brought into contact with the surface of the fabric W and rotated at high speed to raise a nap on the surface of the fabric W. As shown in the image of FIG. 3A before the brushing process and the image of FIG. 3B after the brushing process, a nap is raised on the surface of the fabric. Preferably, the brushing process (S2) is repeatedly performed to maintain the uniformity of the nap over the entire surface of the fabric W.

Then, the back reinforcing process (S3) is performed after the brushing process (S2) has completed by applying a hydrolysis-resistant and flame-retardant coating agent 31 such as a phosphorus-based flame-retardant and water-resistant resin solution to the back side of the fabric W using a coating machine 32, thus reinforcing the back of the fabric W. The back side of the fabric is defined as the side of the fabric which is opposite to the surface on which the nap is raised. As such, when the hydrolysis-resistant and flame-retardant resin solution is coated and cured on the back of the fabric W, the back texture of the fabric is hardened more than in conventional applications and the flexibility of the fabric W is reduced, thus maintaining the planarized surface of the fabric W.

Therefore, it is possible to prevent the decrease in the hydrolysis resistance due to combustible materials on the surface of the resin on the back of the fabric W carbonated by flame lamination, and thus this flame-retardant and water-resistant resin further improves the flame retardancy of the fabric.

Figure 4A:
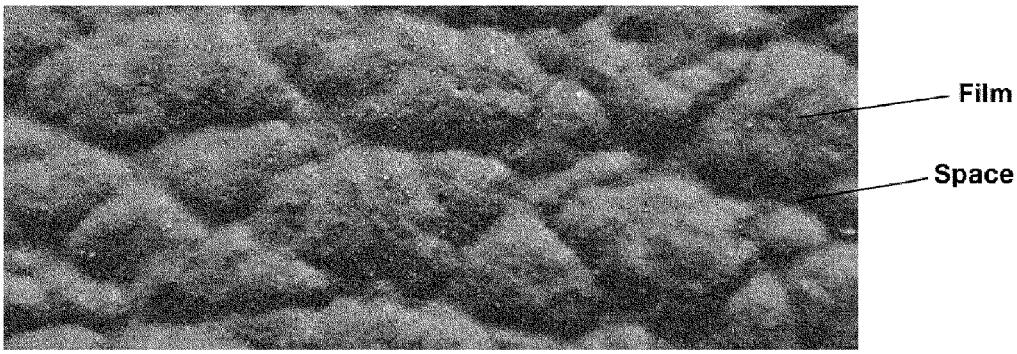
FIGS. 4A and 4B are images showing the surface and cross-section of synthetic leather produce by the method according to the present invention.
Figure 4B:
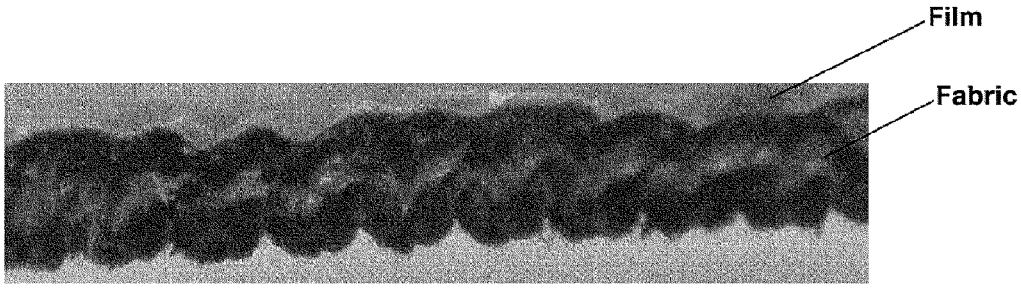
Figure 5A:
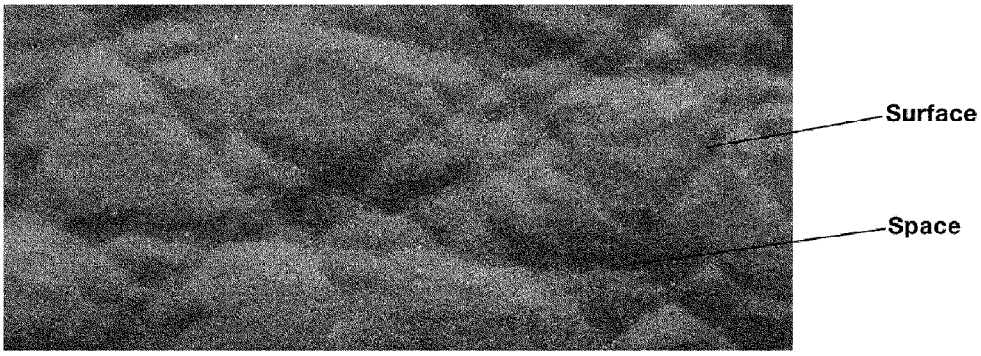
FIGS. 5A and 5B are images showing the surface and cross-section of genuine leather treated with color spray and top protective spray.
Figure 5B:
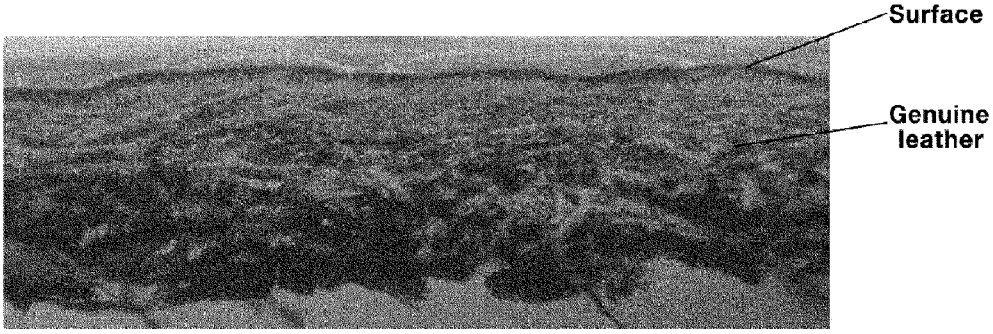

Here, the amount of flame-retardant coating agent 31 is preferably set to a level that will not affect the back reinforcing function and the flame-retardant function and that will not cover the spaces between the threads of the fabric as shown in the images of FIGS. 4A and 4B, thus ensuring air permeability of the fabric W. For example, the amount of hydrolysis-resistant and flame-retardant resin solution coated is preferably about 52 to 60 g/m$^2$. If the amount is less than 52 g/m$^2$, the function of reinforcing the back texture of the fabric W is reduced, and thus the function cannot be sufficiently attained, whereas, if it exceeds 60 g/m$^2$, the flame-retardant coating agent 31 penetrates the spaces between the threads of the fabric W, and thus the air permeability may be reduced. Subsequently, the film forming process (S4) is performed after the back reinforcing process (S3) by applying a thermosetting synthetic resin solution to the nap raised on the surface of the fabric W, thus forming a film on the surface of the fabric W.

A water-soluble polyurethane (PU) resin solution may be used as the thermosetting synthetic resin solution, and the amount of the water-soluble PU resin solution applied is preferably in the range of about 50 to 60 g/m$^2$ to improve the texture of the film and ensure the spaces between the naps, such that all the spaces between the naps, are at least partially not filled, thus allowing the film to have air permeability.

Figure 6A:
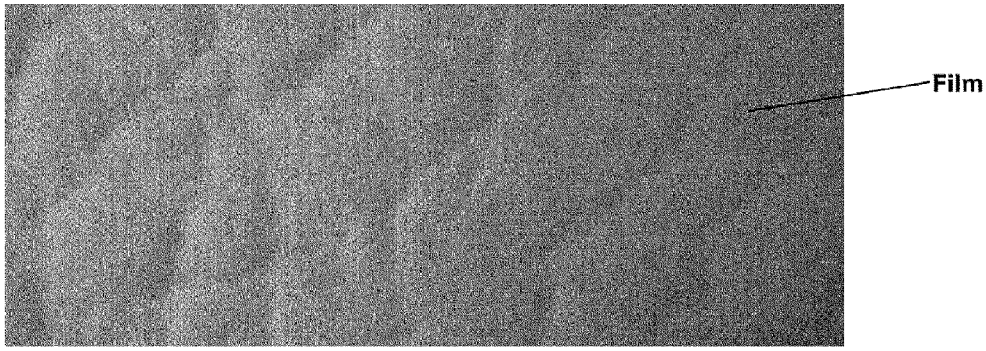
FIG. 6a (PRIOR ART)
FIGS. 6A and 6B are images showing the surface and cross-section of synthetic leather produced by forming a polyurethane film according to a conventional method.
Figure 6B:
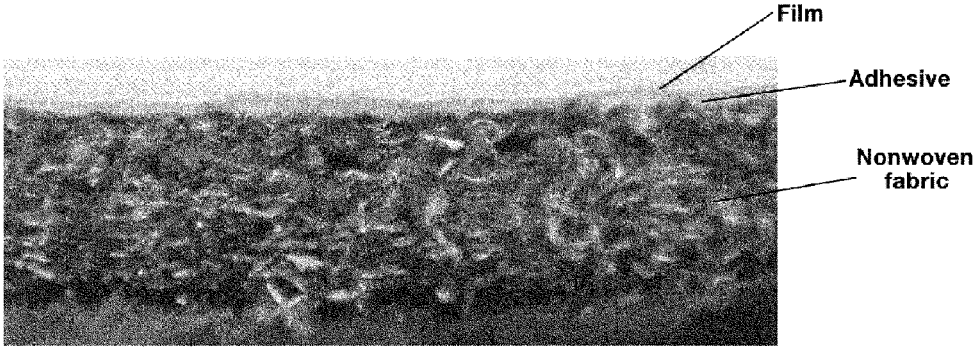
FIG. 6b (PRIOR ART)
Figure 7A:
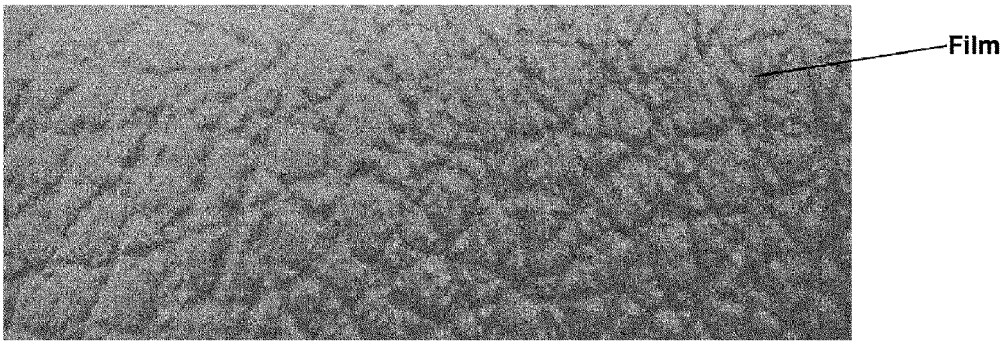
FIG. 7a (PRIOR ART)
FIGS. 7A and 7B are images showing the surface and cross-section of synthetic leather produced by forming a PVC film according to a conventional method.
Figure 7B:
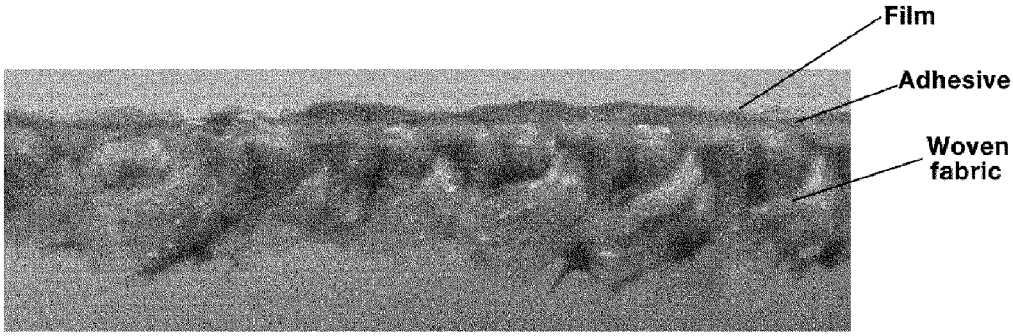
FIG. 7b (PRIOR ART)

As a result, as shown in the images of FIGS. 6A and 6B, it is possible to produce synthetic leather having properties similar to the air permeability and surface texture of genuine leather. For example, if the amount of water-soluble PU resin solution applied is less than about 50 g/m$^2$, most of the resin solution penetrates the spaces between the naps, which make it difficult to form a uniform film on the nap, thus degrading the texture of the film. Moreover, if the amount of PU resin solution applied exceeds about 60 g/m$^2$, a uniform film can be formed on the nap to improve the texture of the film. However, the thus formed film covers the spaces between the naps, which make it difficult to ensure the space, thus reducing the air permeability. Thus, the most preferable range is in between 50 g/m$^2$ and 60 g/m$^2$ of PU resin.

These results were obtained by examining the differences in air permeability and texture through various examples (Example 1 to 3 and Comparative Examples 1 to 3), performed by varying the amount of thermosetting resin solution applied in the film forming process (S4) of the method for producing synthetic resin, in which the softening process (S1), the brushing process (S2), the back reinforcing process (S3), and the film forming process (S4) are sequentially performed, and the results are shown in the following Table 1.

Here, the air permeability was evaluated by cutting the synthetic leathers produced in the Examples and the Comparative Examples into pieces having a size of 18×18 cm and taking three test pieces, respectively. Each sample was mounted at one end of a cylinder, a regulator is used such that an inclined manometer indicated a pressure of a water column of 12.7 mm $H_2O$, and an air permeability tester (Frazier tester) was used. At this time, the amount of air passing through the sample was obtained by measuring the pressure indicated by a vertical manometer and the size of air orifice used.

Moreover, the texture of each sample was evaluated by a sensory test such as feeling tests conducted with 20 individuals. The results of the comparison with the texture of the synthetic leather produced by a conventional dry method were evaluated in three grades of "good", "fair" and "poor" and determined by majority opinion.

TABLE 1

| Classification | Amount of PU resin solution applied (g/m$^2$) | Air permeability (ml/cm$^2$/sec) | Texture |
|---|---|---|---|
| Example 1 | 55 | 0.20 | Good |
| Example 2 | 50 | 0.26 | Fair |
| Example 3 | 60 | 0.12 | Good |
| Comparative Example 1 | 45 | 0.31 | Poor |
| Comparative Example 2 | 65 | 0.07 | Good |
| Genuine leather | — | 0.10 | — |

In the above Table 1, synthetic leathers of Examples 1 to 3 were produced by the same production method of the present invention, in which the softening process (S1), the brushing process (S2), the back reinforcing process (S3), and the film forming process (S4) were sequentially performed, except that the amount of water-soluble PU resin solution varied in the range of 50 to 60 g/m$^2$ in the film forming process (S4).

Synthetic leathers of Comparative Examples 1 and 2 were produced by the same method as Examples 1 to 3, except that the amount of water-soluble PU resin solution was beyond the range of 50 to 60 g/m$^2$ in the film forming process (S4).

As can be seen from the above Table 1, the synthetic leather produced with the PU resin solution in an amount of 55, 50, and 60 g/m$^2$, respectively, in Examples 1 to 3 had air permeability higher than that of genuine leather, and the texture was more desirable than that of the conventional synthetic leather.

On the contrary, in the case of the synthetic leather produced with the PU resin solution in an amount of 45/m$^2$ in Comparative Example 1, the air permeability was higher than that of the genuine leather, however, the texture was less desirable than that of the conventional synthetic leather due to the decreased amount of the PU resin solution. Moreover, in the case of the synthetic leather produced with the PU resin solution in an amount of 65/m$^2$ in Comparative Example 2, the air permeability was higher than that of the genuine leather, however, the texture was more desirable.

It can be seen from the results of the Examples and the Comparative Examples that if the amount of water-soluble PU resin solution applied in the film forming process (S4) was reduced, the air permeability was improved due to the increased number of spaces between the naps, but the texture of the film became poor and, on the contrary, if the amount of water-soluble PU resin solution applied was increased, the texture of the film was more desirable, but the air permeability became poor.

Thus, the above experimental results confirms that the synthetic leather produced with the PU resin solution in an amount within the range of 50 to 60 g/m$^2$, respectively, in Examples 1 to 3 had increased air permeability and texture and thus it was suitable for the product, and the synthetic leather produced with the PU resin solution in an amount beyond the above range in Comparative Examples 1 and 2 had either insufficient air permeability or poor texture, and thus it could not achieve the objects of the present invention.

Figure 2:
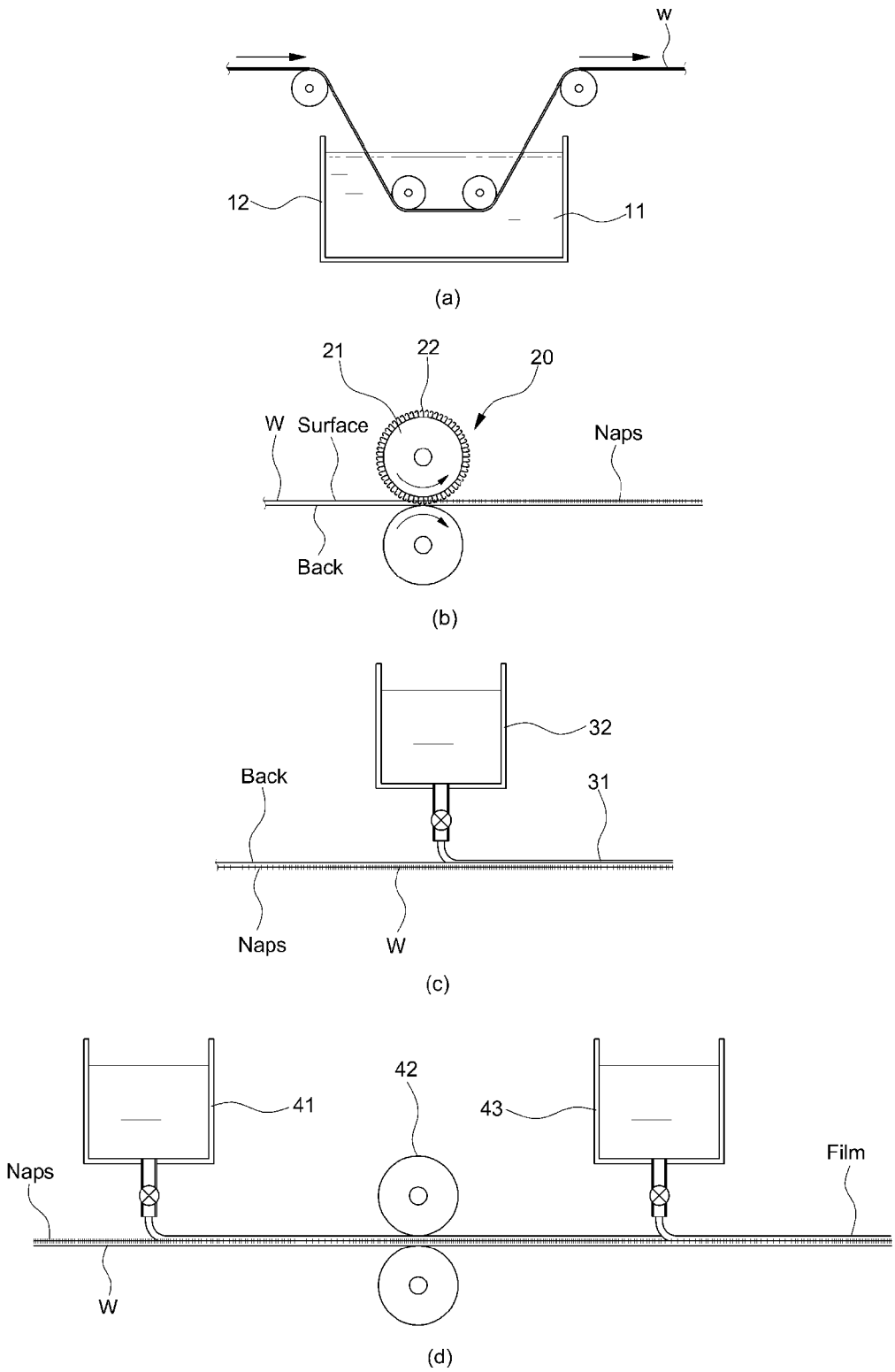
FIG. 2 is a schematic process diagram showing the processes of the method for producing synthetic leather according to the present invention.
Figure 3A:
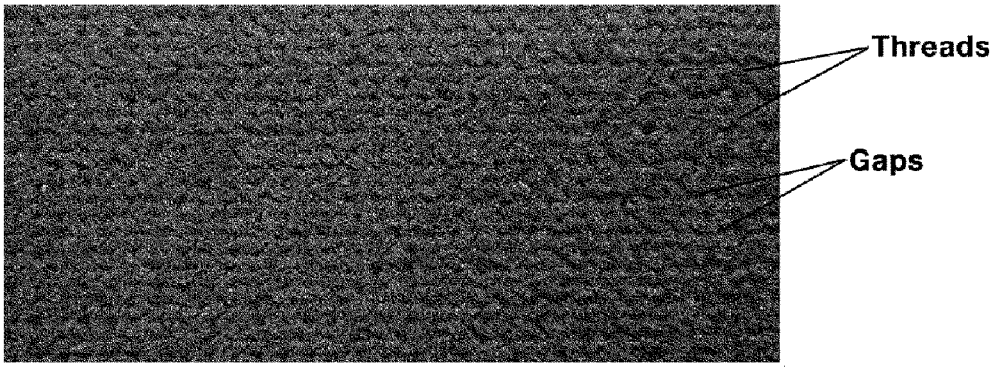
FIGS. 3A and 3B are images showing the surface of a fabric before and after a brushing process in the method for producing synthetic leather according to the present invention.
Figure 3B:
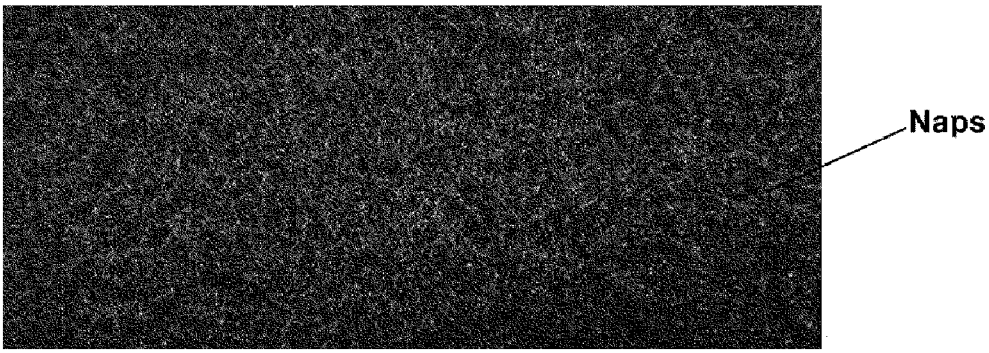

In a exemplary embodiment of the present invention, as shown in FIG. 1 and (d) of FIG. 2, the film forming process (S4) preferably comprises a first coating process (S4-1) for coating a water-soluble PU resin solution in an amount of about 80 to 84% of the total weight on the surface of the film using a coating machine 41, a planarization process (S4-2) for planarizing and drying the surface of the film by uniformly heating and pressurizing the film after the first coating process (S4-1) using a hot press roller 42, and a second coating process (S4-3) for coating the water-soluble PU resin solution in an amount of about 16 to 20% on the surface of the film after the planarization process (S4-2) using a coating machine 43.

Here, during the planarization process (S4-2) after the first coating process (S4-1), it is preferable that the film coated with the water-soluble PU resin solution is dried by heating at a temperature of about 130 to 160° C. Moreover, the film is preferably passed through the hot press roller 42 to heat and pressurize the film at the same time.

In the first coating process (S4-1), the water-soluble PU resin solution is coated in the amount of about 40 to 50 g/m$^2$, which corresponds to about 80 to 84% of the total weight of 50 to 60 g/m$^2$. If the amount of water-soluble PU resin solution applied is less than the above range, the formation of the film on the surface is not sufficient, which results in poor durability (such as abrasion resistance, chemical resistance, and flame retardancy), whereas, if it is more than the above range, the air permeability is reduced. Therefore, the water-soluble PU resin solution is preferably applied in an amount of about 80 to 84% of the total weight.

Moreover, in the second coating process (S4-3), the water-soluble PU resin solution is coated in the amount of about 10 to 12 g/m$^2$, which corresponds to about 16 to 20% of the total weight. If the amount of water-soluble PU resin solution applied is more than the above range, the air permeability is reduced, whereas, if it is less than the above range, the surface texture is reduced. Therefore, the water-soluble PU resin solution is preferably applied in an amount of about 16 to 20% of the total weight.

Moreover, if the film is dried at a temperature below about 130° C. in the planarization process (S4-2) after the first coating process (S4-1), the coated resin is not sufficiently dried, which makes it difficult to emboss a leather pattern on the surface of the film, and the resin may end up being adhered to an embossing roll. Furthermore, if the film is dried at a temperature higher than about 160° C., the surface is hardened and roughened, thus creating an undesirable surface texture.

As such, if the amount of water-soluble PU resin solution applied in the first coating process (S4-1) is greater than that in the second coating process (S4-3), the resin solution quickly passes through the naps to improve the adhesion between the naps and the film. Then, the remaining amount of water-soluble PU resin solution is applied in the second coating process (S4-3), which makes it possible to form a uniform film. Moreover, since the second coating process (S4-3) is performed on the surface of the film planarized by the planarization process (S4-2) after the first coating process (S4-1), a more uniform film can be formed, and thus it is possible to impart a soft texture to the surface of the synthetic leather.

The present invention may further include a pattern forming process (S5), a painting process (S6), and a surface reinforcing process (S7). The pattern forming process (S5) is performed after the film forming process (S4) by performing an embossing process on the film on the surface of the fabric W, thus forming a pattern. For example, a leather pattern is formed on a mold, and the mold is pressed on the fabric W at a temperature of 130 to 150° C. and a pressure of 100 to 200 bar, thus forming a leather pattern on the fabric W. Here, the surface quality is determined by the mold forming process, the temperature of the embossing process, and the process speed.

The painting process (S6) is performed after the pattern forming process (S5) by thinly spraying a water-soluble resin solution, which contains a carbodiimide curing agent and a diluted water-soluble polycarbonate resin for improving water resistance and chemical resistance, on the surface of the film to impart a color thereto.

The surface reinforcing process (S7) is performed after the painting process (S6) by thinly spraying a top protective resin, which contains an ester-based water-soluble PU resin, a diisocyanate curing agent, a silane, and a water-soluble polycarbonate resin, for ensuring the durability (such as heat resistance, cold resistance, chemical resistance, hydrolysis resistance, abrasion resistance, etc.) on the surface of the film to form a protective film for improving the durability of the pattern formed on the surface and ensuring good quality.

The following agents are effective to improve the durability (such as hydrolysis resistance, chemical resistance, abrasion resistance, etc.) of the surface of the film.

TABLE 2

| Classification | Agents used |
|---|---|
| Base coating process | Hydrolysis-resistant, flame-retardant and water-soluble PU resin |
| Color spray process | Non-hydrophilic water-soluble PU resin<br>Pigment<br>Water-soluble polycarbonate resin<br>Carbodiimide curing agent |
| Top spray process | Durability improving resin<br>Diisocyanate curing agent |

TABLE 2-continued

| Classification | Agents used |
|---|---|
| | Water-soluble polycarbonate resin |
| | Silane |
| Durability test results (MS321-08) | Good hydrolysis resistance |
| | Good chemical resistance |
| | Alcohol-resistant, friction coloring |

As shown in the above table, a water-resistant, water-soluble and flame-retardant PU resin was used to improve the water resistance, heat resistance, and chemical resistance during the base coating process, a polycarbonate resin, a carbodiimide curing agent, etc. were used during the color spray process, and a silane was additionally used to improve the adhesion between the resins during the top spray process. Therefore, when the pattern forming process (S5), the painting process (S6), and the surface reinforcing process (S7) are further performed, the surface texture and quality of the synthetic leather can be further improved.

As described above, according to the present invention, after the nap-raising process performed on the surface of the fabric, a film is formed by applying a water-soluble PU resin solution to the nap of the surface of the fabric. At this time, the amount of resin solution applied is set within an appropriate range such that the spaces between the naps are not covered by the film, thereby allowing the fabric to have air permeability through the partially filled in spaces. Moreover, since the resin solution is directly applied to the surface of the fabric such that the resin solution penetrates the spaces between the naps, the adhesion between the fabric and the film is improved to prevent the fabric and the film from being separated or exfoliated. Furthermore, since the durability of the film is improved, the occurrence of cracks can be minimized, and the texture of the film can be maintained good. As a result, it is possible to produce synthetic leather having properties similar to those of genuine leather, and thus the quality of produced synthetic leather can be improved.

Moreover, according to the present invention, in the film forming process, the water-soluble PU resin solution is applied twice in the first and second coating processes. That is, the first coating process is performed such that the resin solution penetrates the spaces between the naps to improve the adhesion. Then, the planarization process for planarizing the surface of the film by uniformly heating and pressurizing the surface of the film is performed such that the resin solution effectively penetrates the spaces between the naps, and then the second coating process is performed. Therefore, the film formed on the naps has a uniform texture, thus further improving the surface quality of the synthetic resin.

Furthermore, according to the present invention, since a softener may be used to impart flexibility to the surface of the fabric before raising the nap on the surface of the fabric, the nap-raising, by the use of the brushing machine, is facilitated. After the film forming process, the process for forming a pattern on the film, the process for imparting a color by spraying a resin solution in which a pigment is diluted on the surface of the film, and the process of reinforcing the surface of the film by spraying a top protective resin on the painted surface of the film are sequentially performed to further improve the quality of the synthetic leather.

The invention has been described in detail with reference to exemplary embodiments thereof. However, it will be appreciated by those skilled in the art that changes may be made in these embodiments without departing from the principles and spirit of the invention, the scope of which is defined in the appended claims and their equivalents.

What is claimed is:

1. A method for producing synthetic leather having air permeability comprising:

brushing, by a brushing process, the surface of a fabric using a brushing machine configured to raise a nap;

coating, by a back reinforcing process, a first resin solution of a hydrolysis-resistant and flame-retardant resin solution on the back of the fabric, wherein the back of the fabric is defined as the side of the fabric opposite to the surface on which the nap is raised, to reinforce the back of the fabric; and applying, by a film forming process, a second resin solution of a water-soluble polyurethane resin solution in an amount of about 50 to 60 g/m$^2$ to the nap of the fabric to form a film such that all the spaces between the naps are at least partially not filled, thus allowing the film to have air permeability; and wherein the film forming process comprises:

coating, by a first coating process, a predetermined amount of the second resin solution on the surface of the fabric;

planarizing and drying, by a planarization process, the surface of the film by heating and pressurizing the film after the first coating process; and coating, by a second coating process, the remaining amount of the second resin solution on the surface of the film after the planarization process, wherein in the first coating process, an amount of about 80 to 84% of the total weight of the second resin solution applied to the nap of the fabric is coated on the surface of the fabric and, in the second coating process, an amount of about 16 to 20% of the total weight of the second resin solution applied to the nap of the fabric is coated on the surface of the film.

2. The method of claim 1, further comprising:

performing after the film forming process, by a pattern forming process, by forming a pattern by performing an embossing process on the film on the surface of the fabric;

imparting, by a painting process, a color by spraying a water-soluble resin solution, which contains a pigment and a carbodiimide curing agent for improving water resistance and chemical resistance, on the surface of the film after the pattern forming process; and increasing, by a surface reinforcing process, the surface durability by spraying a top protective resin on the surface of the film after the painting process.

3. The method of claim 1, further comprising, before the brushing process, performing a softening process imparting flexibility to the surface of the fabric by immersing the fabric in a softening solution containing a softener diluted in water and stored in a reservoir and drying the resulting fabric.

4. The method of claim 1, wherein in the planarization process, the film after the first coating process is dried by heating at a temperature of about 130 to 160° C.

5. The method of claim 1, wherein in the planarization process, the fabric after the first coating process is passed through a hot press roller such that the fabric is heated and pressurized at the same time.

* * * * *